US005748107A

United States Patent [19]

Kersken et al.

[11] Patent Number: 5,748,107

[45] Date of Patent: May 5, 1998

[54] METHOD AND APPARATUS FOR LOCATING AN AVAILABLE PARKING FACILITY

[75] Inventors: Ulrich Kersken, Hildesheim; Hinrich Claussen, Diekholzen, both of Germany

[73] Assignee: Robert Bosch GmbH, Stuttgart, Germany

[21] Appl. No.: 809,572

[22] PCT Filed: Aug. 24, 1995

[86] PCT No.: PCT/DE95/01122

§ 371 Date: Mar. 24, 1997

§ 102(e) Date: Mar. 24, 1997

[87] PCT Pub. No.: WO96/09615

PCT Pub. Date: Mar. 28, 1996

[30] Foreign Application Priority Data

Sep. 23, 1994 [DE] Germany ..... 44 33 982.8

[51] Int. Cl.[6] ..... G08G 1/09

[52] U.S. Cl. ..... 340/905; 340/995; 340/932.2; 341/23; 345/172; 364/449.2; 364/449.3

[58] Field of Search ..... 340/905, 932.2, 340/988, 991, 995; 341/22, 23; 345/168, 172; 364/449.1–449.4

[56] References Cited

U.S. PATENT DOCUMENTS 4,974,170 11/1990 Bouve et al. ..... 364/518
5,103,400 4/1992 Yamada et al. ..... 364/444
5,231,584 7/1993 Nimura et al. ..... 364/444
5,635,953 6/1997 Hayami et al. ..... 345/146

OTHER PUBLICATIONS

"Verkehrsmanagement Stadtpilot", Funkschau (Mar. 1994), pp. 49–51.

*Primary Examiner*—Jeffery Hofsass
*Assistant Examiner*—Daryl C. Pope
*Attorney, Agent, or Firm*—Kenyon & Kenyon

[57] ABSTRACT

In a method and an apparatus for finding an available parking lot, when information about an available parking lot is requested, a locating system first determines the current motor vehicle position, and finds the possible parking lots in a search area on the basis of this position. The data about parking lots are preferably transmitted using the TMC channel of the Radio Data System (RDS). If there are several cities in the search area, then a corresponding selection for a city can be made using an input device. Furthermore, districts with parking lots located in these districts can be selected, in order to find a parking lot as close to the destination as possible. In the case of P+R lots, the connections to the public transit system are also output, along with additional information, for example the train frequency. The apparatus is integrated into a car radio, so that the receiver part, input device, and displays of the car radio can be utilized.

13 Claims, 11 Drawing Sheets

| Parking Garage | Status |
|---|---|
| P1 | 00 |
| P2 | 01 |
| P3 | 03 |
| P4 | 02 |

Fig. 9

| Parking Garage | Coordinates | district S |
|---|---|---|
| P1 | 50/80 | 0 |
| P2 | 33/43 | 0 |
| P3 | 51/79 | 1 |
| P4 | 50/79 | 4 |

Fig. 10

| City | Coordinates | Commuter area (15) |
|---|---|---|
| Hildesheim | 34/43 | 30km |
| Hannover | 50/81 | 50km |
| Salzgitter | 70/90 | 20km |

Fig. 15

METHOD AND APPARATUS FOR LOCATING AN AVAILABLE PARKING FACILITY

FIELD OF THE INVENTION

The present invention relates to a method and an apparatus for finding an available parking lot or parking garage.

BACKGROUND INFORMATION

Publication "Verkehrsmanagement Stadtpilot"(Traffic Planning City Pilot), Funkschau 3/1994, pages 49 to 51, a "City-Pilot" describes a method with which a driver can already obtain all the important information relating to available parking lots as well as all lines of the public transit system, with departure times and connections, for a major city and its commuter area. The required data for this city are either transmitted directly to the terminal, via the radio data system (RDS system), or also via variable message signs which are controlled via RDS. The City-Pilot has a display on which the desired data can be displayed by pressing keys the appropriate number of times. However, it is disadvantageous that the device cannot determine its own location. Therefore all the received data have to be manually searched until a certain destination with an available parking lot is found. In view of the large number of data which can be transmitted with the RDS system, this search process can be very time-consuming. Using this process while in a moving motor vehicle, for example, could therefore overly distract the driver from the traffic events around him.

SUMMARY OF THE INVENTION

In contrast, the method of procedure, according to the present invention for finding an available parking lot for a motor vehicle has an advantage that by determining the current position of the motor vehicle, a preselection of the data can take place, and only the data which lie within the given search area are displayed. The search area can be selected in such a way that only one city or one district is covered, and the available parking lots or parking garages for this city or district are output. If, on the other hand, there are several cities or districts in the search area, the driver can make a simple selection by pressing the appropriate keys. With the apparatus according to the present invention, the RDS system of a car radio can be used to determine an available parking lot, so that the advantages of the car radio, namely the receiver part, the existing display and any input keys, as well as a control of a microprocessor, for example, can also be used. This results in significant cost advantages in the production of the apparatus according to the present invention.

It is further advantageous that a simple and current selection of a destination can be made by assigning the keys to the districts.

Since the parking lots or parking garages are assigned to a district, the parking lot can therefore be displayed automatically, without further selection measures being required.

Another advantage according to the present invention is that the lines of the public transit system and/or their schedules are also output in the selected district. Since the selected district is relatively small, its representation is easily surveyed, particularly if an electronic street map is being used.

It is particularly advantageous that in the apparatus for carrying out the method for finding an available parking lot, the selection of a district can be made using an input device which is structured as a key pad. Pads with nine, ten or sixteen keys are usual, for example, for calculators, and rocker keys are usual for car radios, all of which are familiar to the user. It is particularly advantageous if each key of a key pad is assigned to at least one district, in accordance with its geographical location. This simplifies operation when selecting a district, so that the driver can easily operate the device even while driving.

A particularly precise and targeted selection of the destination, i.e. of a district, is achieved by repeatedly pressing a key. By assigning the keys multiple functions, space is saved on the front panel of the car radio, without losing clarity for the selection of a district.

By using a navigation or destination guidance system, there is the advantage that the driver is automatically guided to the available parking lot or parking garage. This is particularly advantageous for persons who are not from that city.

BRIEF DESCRIPTION OF THE DRAWINGS

FIG. 9 shows an example of a status table.

FIG. 10 shows an allocation table for parking facilities.

FIG. 15 shows a selection table.

DETAILED DESCRIPTION OF THE INVENTION

Figure 1:
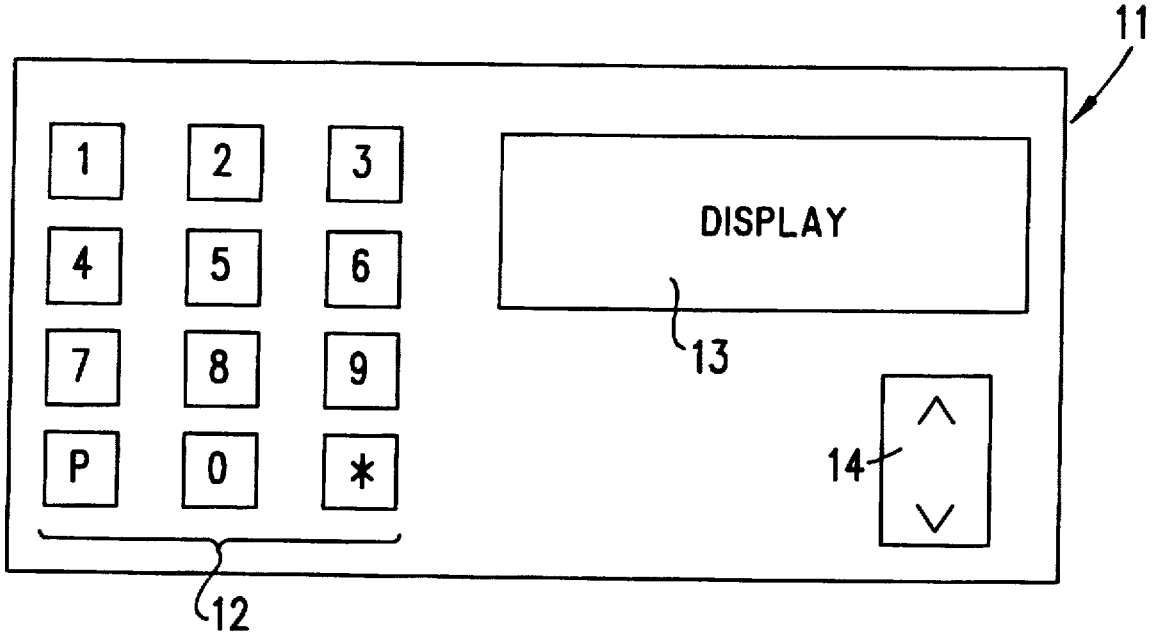
FIG. 1 shows a first exemplary embodiment of a car radio according to the present invention.

An exemplary embodiment according to the present invention illustrated in FIG. 1 shows a car radio 11, which has a key pad 12 on the left side. The key pad 12 is shown to be similar to a touch-tone telephone, with twelve keys, where the keys 0 to 9 are used to select districts. Key P serves to activate the parking lot search, and a key * serves to stop the current function or to switch to the radio function. Another key 14 serves as a selection key, preferably a rocker key, in order to select a destination or a district on a display 13, if this is necessary. For reasons of clarity, the operating elements for the car radio or its cassette player are not shown in FIG. 1. The display 13 can be used both for displays of the car radio function, and for the parking lot search.

Figure 2:
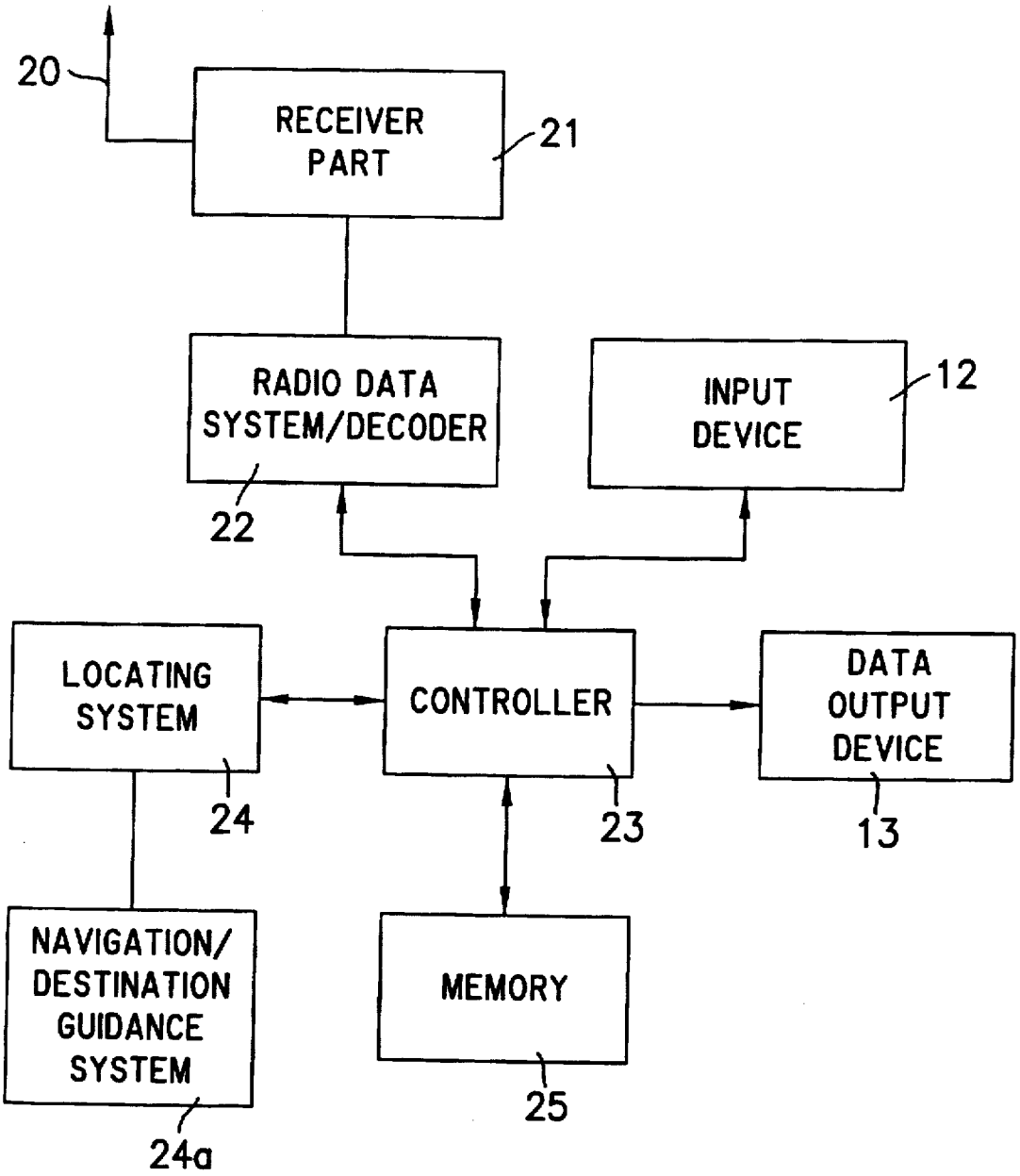
FIG. 2 shows a block schematic of a device according to the present invention.
Figure 4:
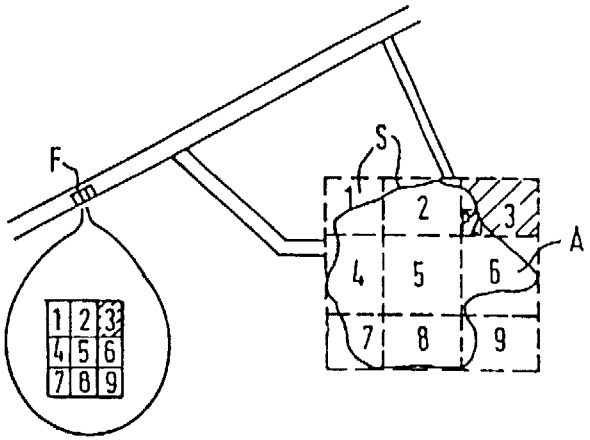
FIG. 4 shows a first example of parts of a street map.
Figure 5:
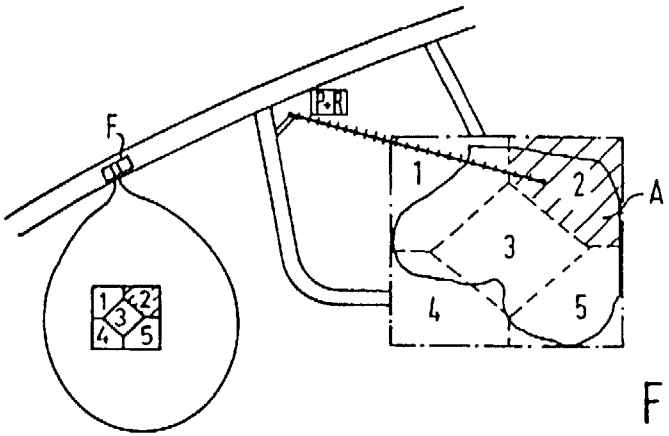
FIG. 5 shows a second example of parts of the street map.
Figure 3A:
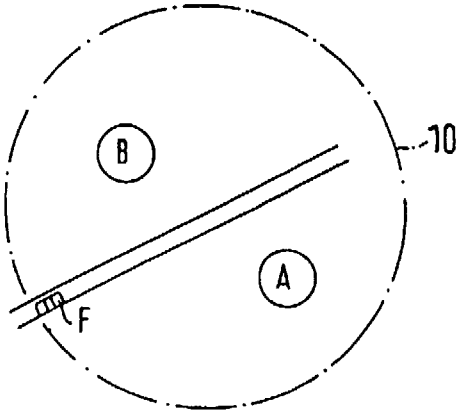
FIG. 3*a* shows a first example of a search area, i.e. a commuter area.
Figure 3B:
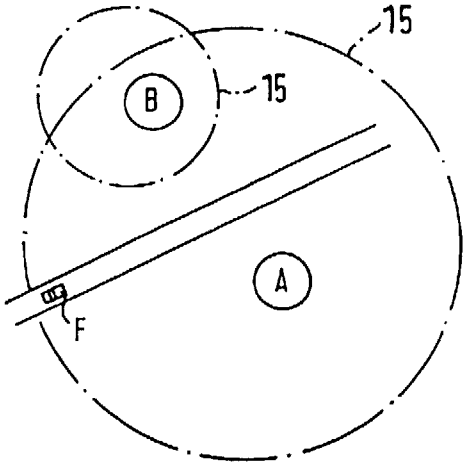
FIG. 3*b* shows a second example of the search area.

FIG. 2 shows a block schematic of the car radio 11. In addition to a conventional receiver part 21 with an antenna 20, the car radio is equipped with the Radio Data System or decoder (RDS) 22. The RDS system 22 has a Traffic Message Channel (TMC), which is designed for transmission of traffic messages for one or more district segments. The RDS decoder 22 is connected with a message memory in which the current traffic messages are stored and can be called up if needed. The RDS-TMC system and decoder are known as such to one of ordinary skill in the art and therefore do not require any further explanation. Data concerning stationary traffic, variations i.e. available parking lots, parking garages or P+R lots, can now be transmitted via free blocks of the TMC channel. The car radio 11 is furthermore connected with a locating system 24, which can determine the current vehicle location using wheel sensors, a compass or the Global Position System (GPS). The locating system 24 can also be connected with a navigation and destination guidance system 24*a*. A microprocessor is provided as a controller 23, which is connected with the connected systems as well as the input device 12 and a data output device 13. Furthermore, the controller 23 is connected with a memory 25, which contains a table for the towns and their coordinates. Also, additional data such as a commuter area 15 of the towns, (see, e.g., FIG. 36) coordinates and names of parking garages, and their allocation to districts S, can be stored in memory in the table. FIGS. 3*a*, *b* schematically show the sequence of a search process for a parking lot or a parking garage. When approaching a city A or B, when the key P (see, e.g., FIG. 1) is activated, this is recognized as being a request for a search of parking possibilities, preferably in a parking garage. Alternatively, by pressing another key or pressing the key P several times, a selection can be preselected for P+R parking lots (Park and ride). FIGS. 3*a* and 3*b* show a vehicle F covering a search area 10 which includes the cities A and B, in the direction of travel. The search area 10 can lie in a circle in front of the vehicle F, for example. If the desire to find a parking possibility is expressed by pressing the key P, the controller 23 first gets the current vehicle position from the locating system 24. On the basis of this position and the coordinates from commuter area (Table) 15, the cities A and B which lie in the search area 10 are selected. The cities A, B are now output on the data display 13, using a visual display or over a loudspeaker. The driver can then select whether he is looking for a parking lot in city A or B, by pressing the selection key 14. In FIG. 3*b*, on the other hand, it is assumed that instead of the search area 10, each city A and B has its own commuter area 15. If, for example, the vehicle F is in the commuter area 15 of the city A, then the RDS data for city A are directly selected. This information about the available parking lots, parking garages or P+R lots was previously transmitted to the memory of the RDS/TMC channel in the reception area in question, for all the cities. As shown in FIGS. 4 and 5, a further selection is made using the key pad 12. In FIG. 4, a nine-key pad is provided, divided up into a 3×3 matrix. The individual keys 1 to 9 are now geographically assigned to the city area, for example, to city A, in such a way that the upper row of keys, 1 to 3, corresponds to the northern parts of the city, the center row of keys, 4 to 6, corresponds to the center parts of the city, and the bottom row of keys, 7 to 9, corresponds to the southern parts of the city. By pressing the key 3, for example, the northeastern part of city A is selected. There is a parking garage P2 in this district, and it is now automatically output as a destination.

FIG. 5 shows an alternative key arrangement for searching for a P+R lot with a key pad 12, where this key pad has only five keys. The key 3 covers the central district, while the keys 1, 2, 4, 5 cover the outlying districts. If the northeast part of city A is selected by pressing the key 2, then the controller 23 finds a P+R lot in this district. The P+R lot is assigned to this district S, since it can be reached via a connection of the public transit system. The same holds true for parking lots or parking garages. In this case, the connection of a public transit system, for example line 5, is drawn in; this line leads directly to the northeastern part of the city A. As additional information, the driver receives the departure frequency, for example every five minutes, and/or the schedules, so that he is also informed about train frequency. For a selection, the districts S must be assigned to the keys of a key pad.

Figure 6C:
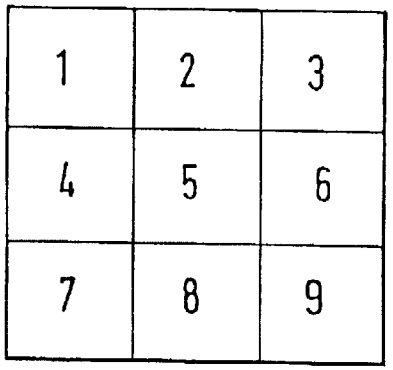
FIG. 6*c* shows a second example district allocation as illustrated in FIG. 6*a* to keys of the key pad according to the present invention.
Figure 6B:
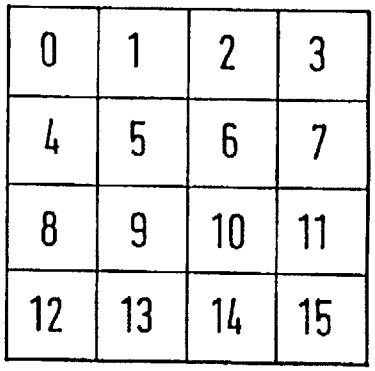
FIG. 6*b* shows a first example district allocation as illustrated in FIG. 6*a* to keys of a key pad according to the present invention.
Figure 6A:
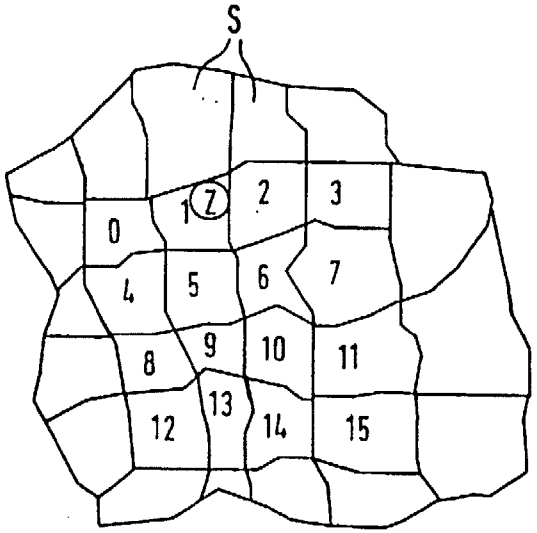
FIG. 6*a* shows districts within the street map.

FIGS. 6*a* through 6*c* show the allocation of downtown districts 0 to 15 to a 9-key pad. FIG. 6*b* shows an abstract allocation, like a grid, of the districts S. These grid areas can then be assigned to a key pad. The outlying districts are ignored in this connection, since they are not relevant in the present example. If a 9-key pad shown in FIG. 6*c* is used, then the keys 1 to 9 can be assigned to the districts 0 to 15 indicated, by using the following allocation table:

Allocation Table 1

| | Keys | | | | | | | | |
|---|---|---|---|---|---|---|---|---|---|
| | 1 | 2 | 3 | 4 | 5 | 6 | 7 | 8 | 9 |
| Districts | 0 | 1 | 2 | 4 | 5 | 7 | 9 | 13 | 14 |
| | 1 | 2 | 3 | 8 | 6 | 11 | 12 | 14 | 15 |
| | 4 | | 7 | | 9 | | 13 | | 14 |
| | | | | | 10 | | | | |

Figure 7C:
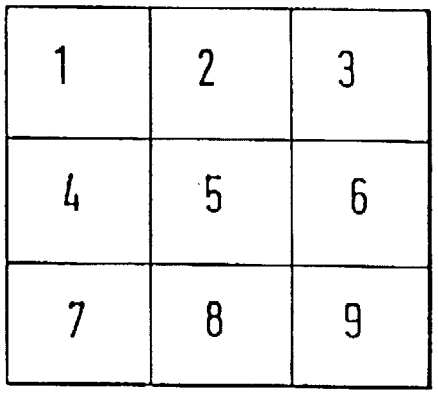
FIG. 7*c* shows a second example district allocation as illustrated in FIG. 7*a* to keys of the key pad according to the present invention.
Figure 7B:
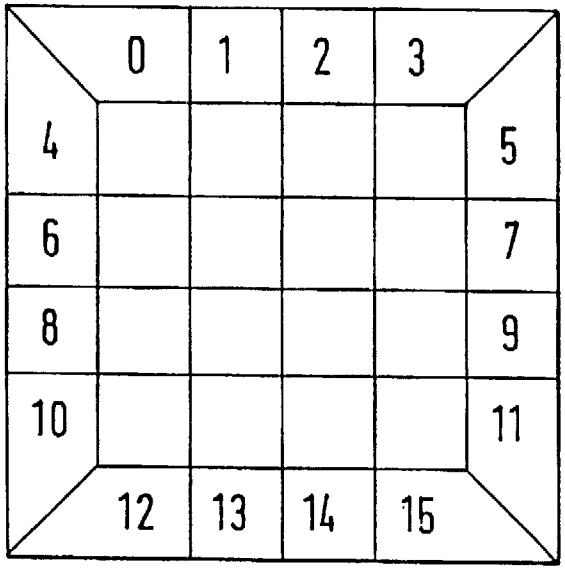
FIG. 7*b* shows a first example district allocation as illustrated in FIG. 7*a* to keys of a key pad according to the present invention.
Figure 7A:
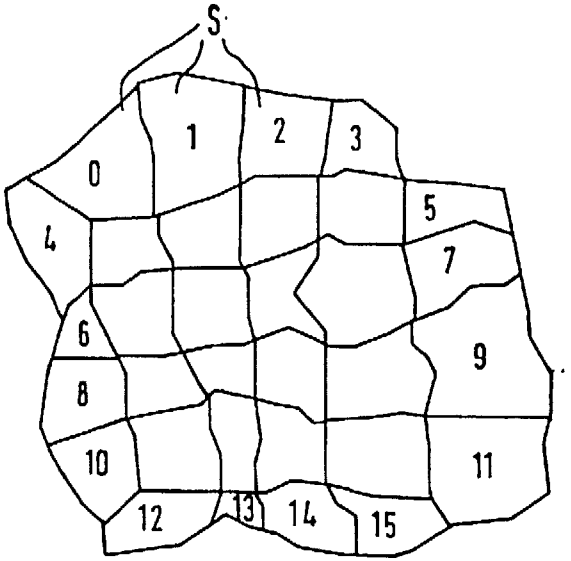
FIG. 7*a* shows other possible districts within the street map.

Analogous to FIGS. 6*a*, 6*b*, and FIGS. 7*a*, 7*b* show another exemplary embodiment, according to the present invention in which the outlying parts of the districts 0 to 15 (FIG. 7*a*) are assigned to the grid areas 0 to 15. FIG. 7*c* shows an input device 12 with a 9-key pad, which is assigned to the following allocation table 2, for example. It is advantageous if switching from the downtown area to the outlying area of the city is done by pressing the corresponding keys twice. In order to access the outlying district 1, for example, the key 1 is pressed twice, while pressing it once selects the district 1 according to FIG. 6*a*.

Allocation Table 2

| | Keys (press 2x) | | | | | | | | |
|---|---|---|---|---|---|---|---|---|---|
| | 1 | 2 | 3 | 4 | 5 | 6 | 7 | 8 | 9 |
| Districts | 0 | 1 | 3 | 6 | downtown | 7 | 10 | 13 | 11 |
| | 4 | 2 | 5 | 8 | district | 10 | 12 | 14 | 15 |

Figure 8:
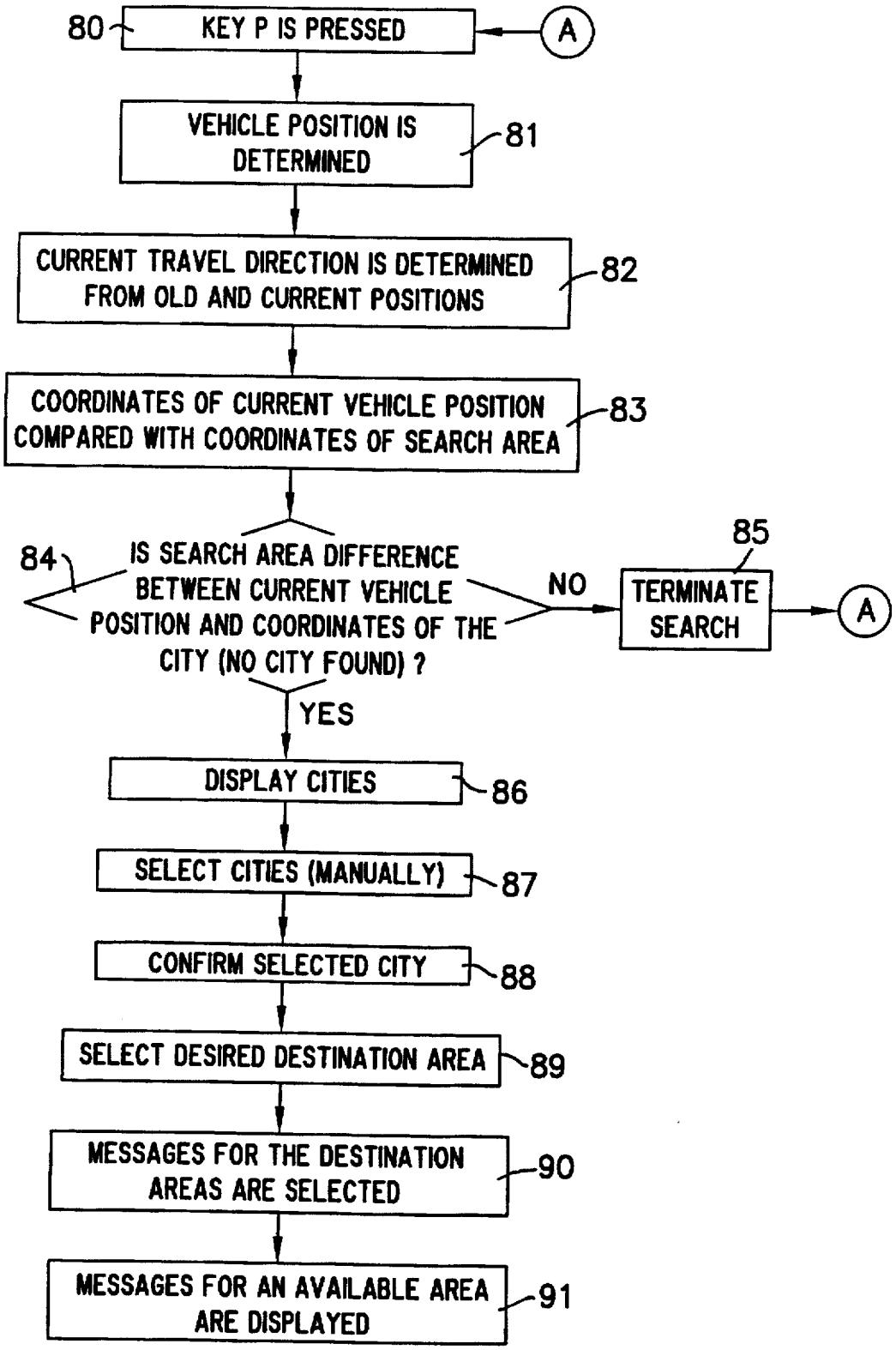
FIG. 8 shows a flow chart of the method according to the present invention.
Figure 11:
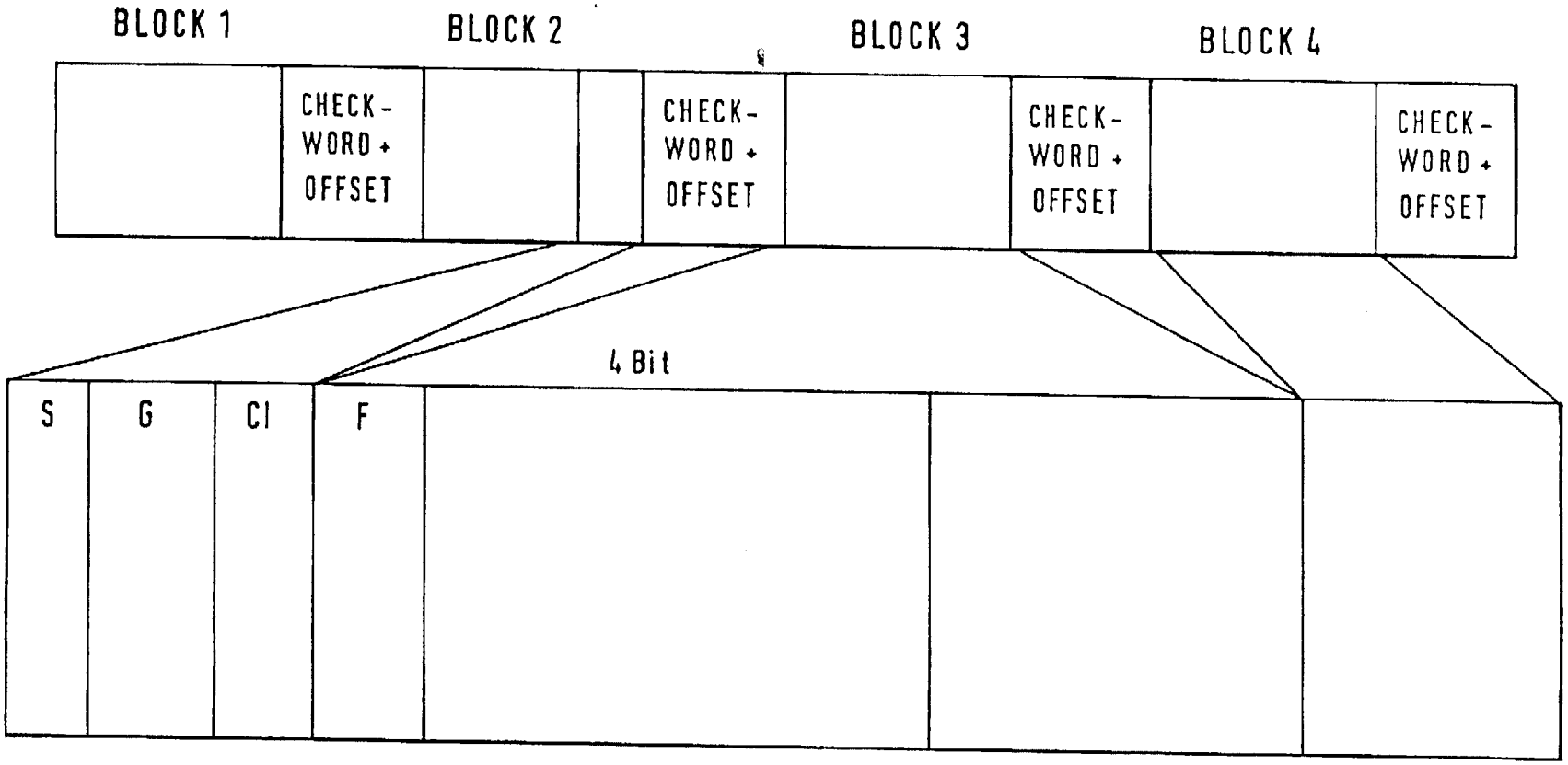
FIG. 11 shows a first sequence of a data telegram.
Figure 14:
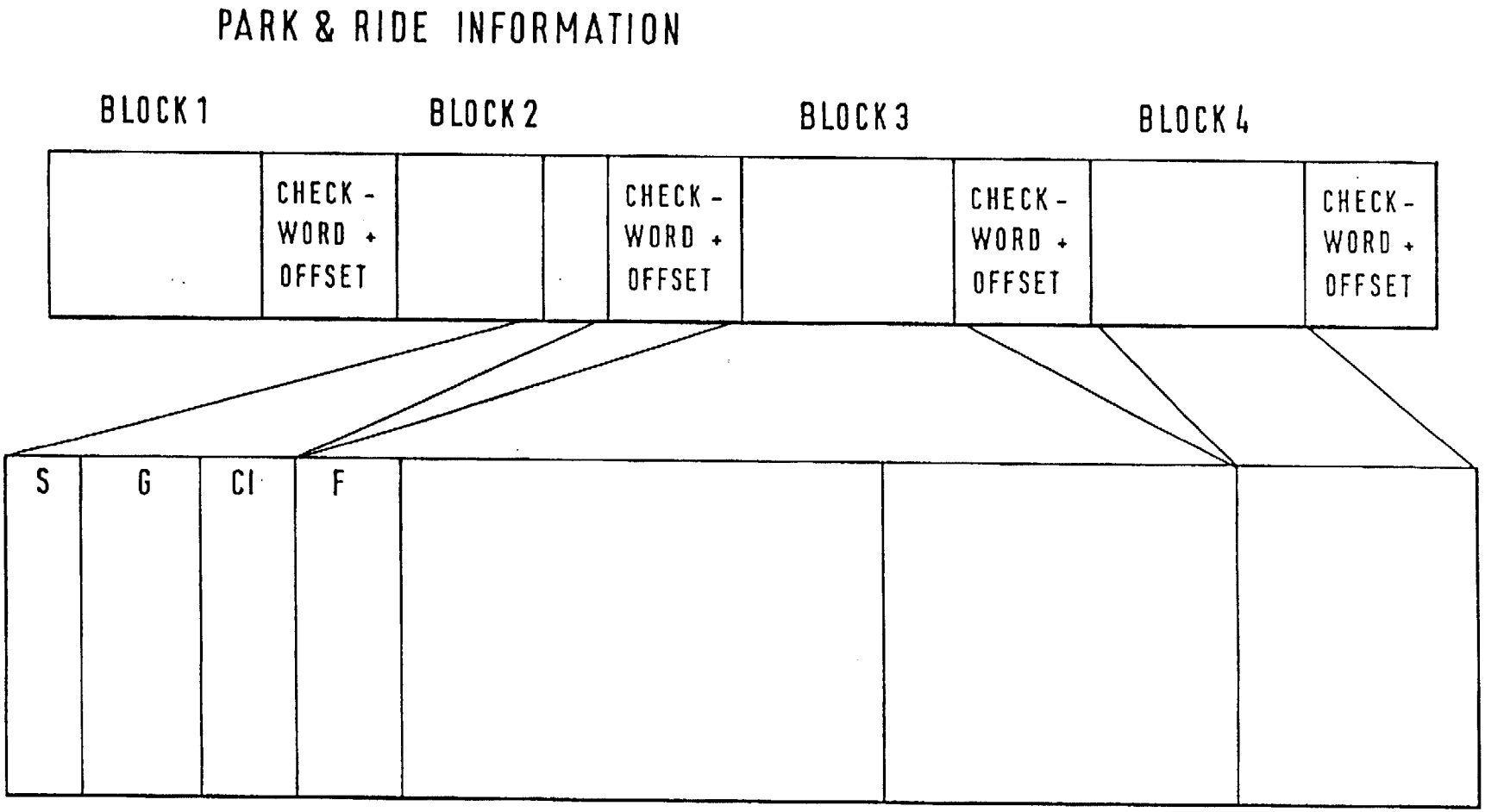
FIG. 14 shows a fourth sequence of the data telegram.

FIG. 8 illustrates the functioning of the method and apparatus according to the present invention, for finding an available parking lot, in greater detail. To activate the search system, the key P of the key pad 12 is pressed in position 80. In position 81, the locating system 24, for example the navigation system "Travel Pilot," or using the Global Position System, determines the current vehicle position and passes it on to the controller 23. Locating systems are commercially available and therefore do not require any further explanation. In position 82, the current travel direction is determined from the old position and the current position. In the travel direction, a search area is now formed as shown in FIG. 3*a*, which can have a diameter of 20 km, 30 km or 50 km, for example, taking the current vehicle position into account. Instead of the search area 10, a commuter area 15 assigned to a city A can also be used. The coordinates of the city as well as the size of the commuter area can be stored in memory in a selection table (See e.g., FIG. 15). The RDS/TMC messages occur in sequences, where each sequence is divided into several blocks. For P+R information, FIG. 14 shows a first sequence, in which the various town codes of the various cities are transmitted in block 4. As is further evident from FIG. 4, a grid area number for the district identification, as well as the means of public transit, such as intracity trains, streetcars, subway trains, busses or intercity trains are indicated or transmitted in block 3. FIG. 11 shows a similar sequence, but this one contains information about the stationary traffic, i.e. concerning parking spaces in parking garages, without a connection to the public transit system. The town code indicates the town for which the messages concerning stationary traffic variations apply. In the memory 25, additional town coordinates are stored for the town codes. For example, as shown in FIG. 15, these town coordinates are 34/43 for Hildesheim, 50/81 for Hanover, and 70/90 for Salzgitter. In position 83, the coordinates of the current vehicle position are now compared with the coordinates in the search area 10, i.e. commuter area 15. In position 84, an inquiry is made whether the search area is smaller than the difference between the current vehicle position and the coordinates of the city (FIG. 15). If the search area 10 is smaller, i.e. if no city was found, then the search area is expanded by a predetermined value, for example to 30 km or 50 km. If no city was found, then the search process is broken off in position 85, and the program is started again with position 80. If, on the other hand, one or more cities are found in the search area, then these cities are displayed in position 86. If several cities were found, then a manual-selection of the cities displayed can be made in position 87, using the selection key 14. In position 88, the selected city is confirmed, for example by pressing the key P. In position 89, the key pad 12 can now be used to select a desired destination area, i.e. one or more districts S corresponding to FIGS. 6*a*, 7*a* and the allocation tables 1, 2, by pressing one of the keys. By means of selecting the district S, the messages from the RDS memory which are stored for this district are now selected in position 90. In particular, these are messages concerning available parking lots, parking garages or P+R lots.

The size of a city determines the number of required districts S, i.e. the required grid areas. For small cities, for example, the 16 grid areas (FIG. 6*a*) are sufficient. For larger cities, more grid areas are needed, in order not to reduce the accuracy. The most detailed grid possible is always a goal, if only in order to make a logical allocation of the grid areas to the most varied types of input devices possible. Another restriction of the grid areas results from the available data bits in the TMC channel. For the TMC channel, protocols have already been established for the transmission of data structures. Such a protocol is known under the name ALERT C. If the structures are taken into consideration, then four bits are available for the grid area numbering, so that a total of 16 different grid areas is obtained. In addition, the event is transmitted for the 16 grid areas. An event for parking garages, for example, is the "information for stationary traffic in the downtown area" of a city. Corresponding to FIG. 6*a*, the individual districts and grid areas are numbered consecutively. Each parking lot is assigned to a grid area in accordance with its geographical location in the district, or on the basis of its city-planning allocation. Using the eleven bits which are available for events, more events than are currently being utilized can be defined, so that additional events can also be defined. Cities which cannot make do with the basic grid can produce a ring-shaped expanded network in accordance with FIG. 7*a*, by using additional defined events, and display the districts on it. For example, the events can be as follows:

2000 "Info for the stationary traffic in the downtown area"

2001 "Info for the stationary traffic in outlying area 1"

2002 "Info for the stationary traffic in outlying area 2"

2003 . . . etc.

The district identification (event+grid area) is transmitted in every message, in block 3 of the first sequence (FIG. 14, 11).

In the vehicle device, preferably the car radio 11, one or more districts S are assigned to a key, depending on the type of input device (see, e.g., FIGS. 6*c*, 7*c*, allocation tables 1, 2).

Figure 12:
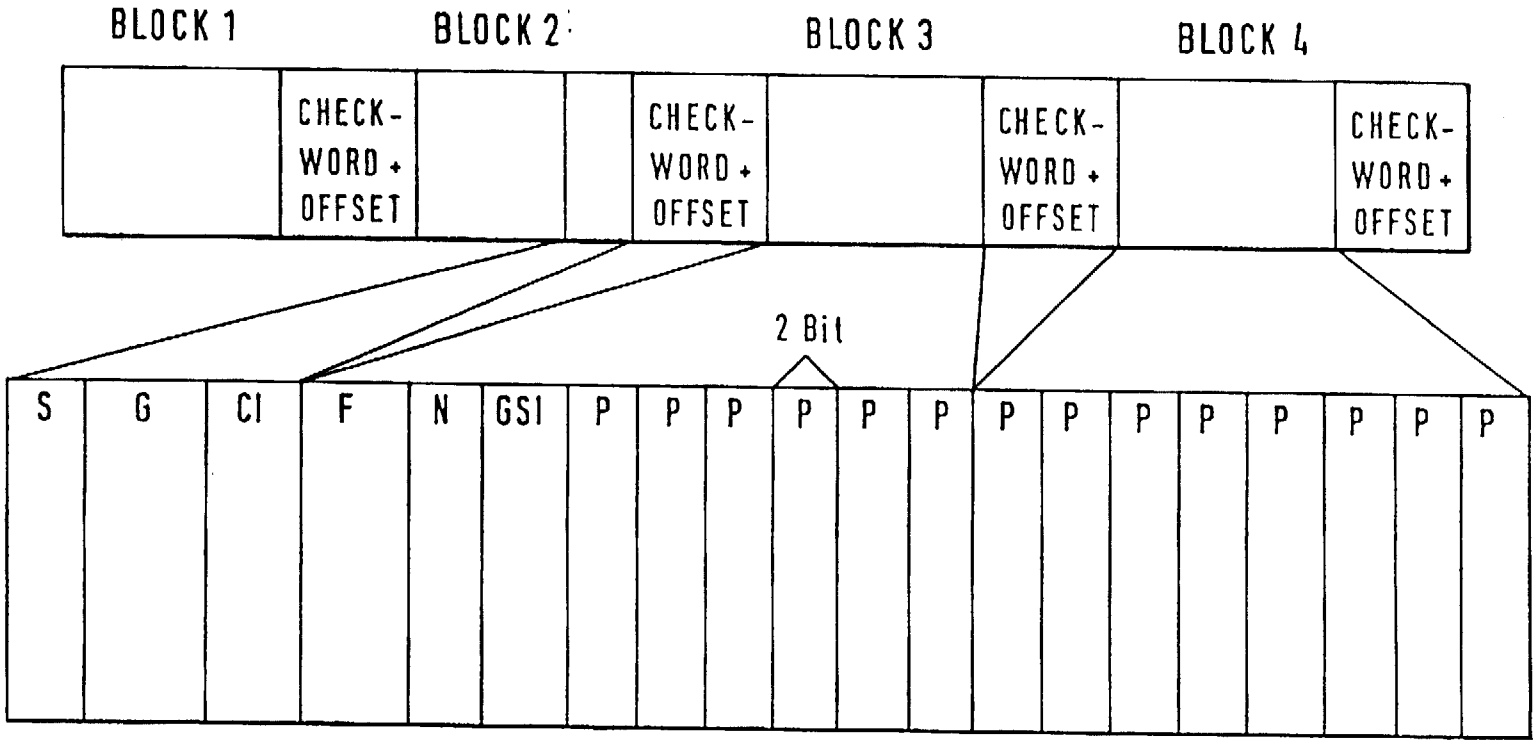
FIG. 12 shows a second sequence of the data telegram.
Figure 13:
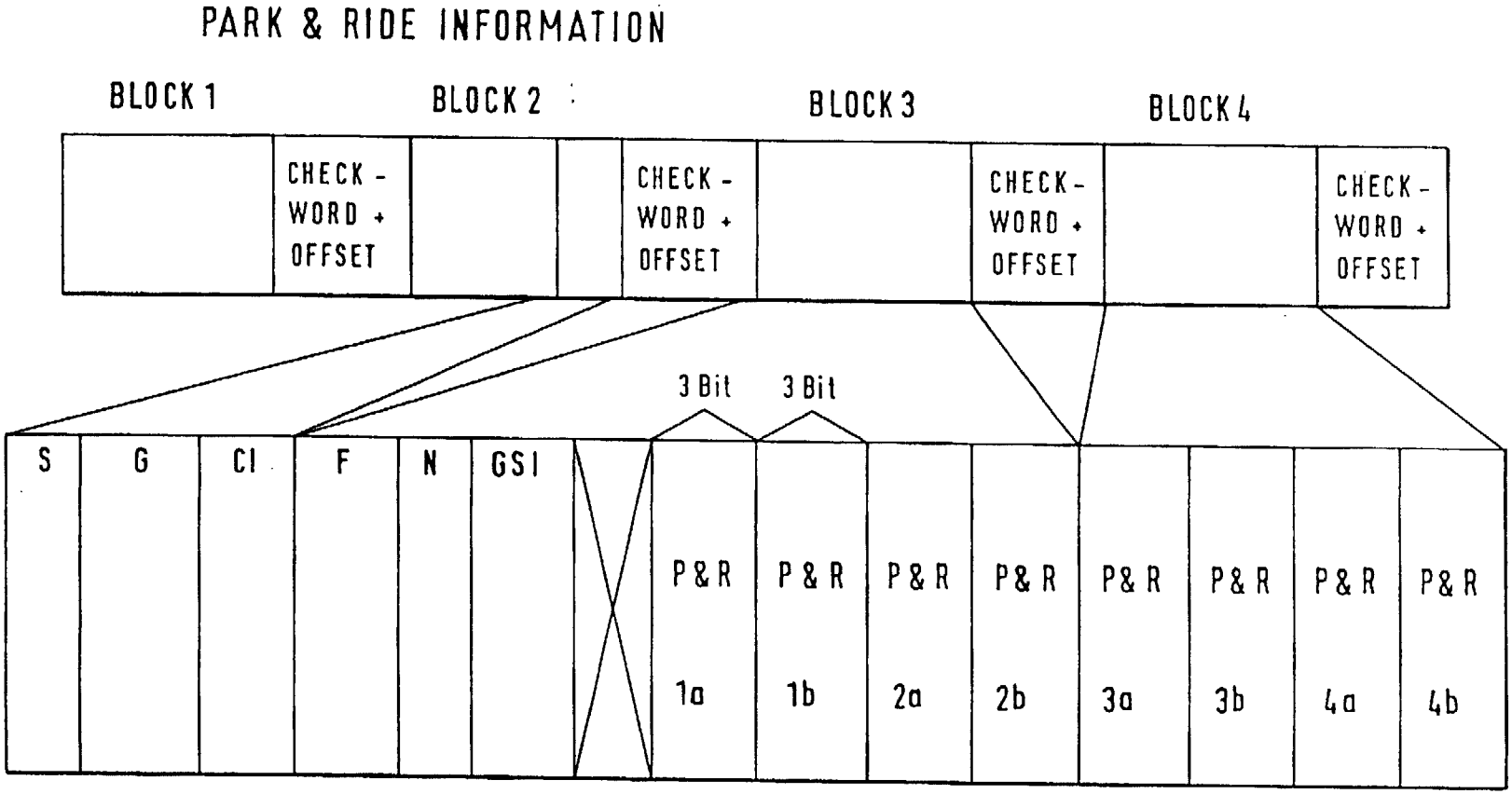
FIG. 13 shows a third sequence of the data telegram.

A following example will be explained below in greater detail:

A selection of a parking garage is made, for example, according to the table in FIG. 10. For example, according to the left column, all the parking garages P1, P2, P3 and P4 which are assigned to the selected district S are displayed. If, for example, the key 1 was pressed in accordance with the FIGS. 6*a* and 6*c*, then the districts 0, 1, 4 are selected, taking into consideration the allocation table 1. As shown in FIG. 10, in these districts 0, 1, 4, the parking garages P1, P2 are assigned to the district 0 (right column), the parking garage P3 is assigned to the district 1, and the parking garage P4 is assigned to the district 4. If a parking garage in the district 0 is desired, then the parking garage P1 or P2 can be selected. At the same time, the coordinates of this parking garage are displayed, so that the way to the parking garage can also be displayed on a street map, or the destination route can be output acoustically, for example in connection with a navigation system. FIG. 9 now shows a table with the occupancy status of the available parking garages. The occupancy status is transmitted with the second sequence of the TMC protocol (FIG. 12), and indicates, for example in a text message, whether only individual parking spaces are still available (Code 00), whether there is plenty of space (Code 01), whether the parking garage is full (Code 02), or no information is given (Code 03).

For finding a P+R lot, a similar allocation as for the parking garages is selected. The event numbers and the related events differ by the additional information about the public transit system, and can be as follows, for example:

2005 "Bus connection at P+R in downtown area"

2005 "Bus connection at P+R in outlying area 1"

2006 "Bus connection at P+R in outlying area 2"

2008 . . . etc.

In addition, in a second sequence for a district, the P+R lots which have one or more public transit connections with the selected district S are transmitted. Each data set about a P+R lot consists of two fields (a and b field). In the a field, the travel time from the P+R lot to the selected district is indicated. In the b field, the train frequency in minutes is indicated. For the P+R lots, the controller 23 looks for the messages which relate to the selected district S. Therefore the closest P+R lot can automatically be selected, since the position of both the selected district and the P+R lot are known. If there is a choice of more than one P+R lot, then a certain lot can be selectively searched for. Finally, in position 91 (FIG. 8), the occupancy status of the selected parking garage is also indicated (FIG. 9). Of course the information can be displayed summarized in a table, so that greater clarity is possible.

What is claimed is:

1. A method for locating at least one available parking facility for a motor vehicle, comprising the steps of:

requesting parking data corresponding to the at least one available parking facility;

determining a current position of the motor vehicle using a locating system when the parking data is requested;

receiving the parking data related to the at least one available parking facility corresponding to at least one assigned town code;

predetermining a search area corresponding to the current vehicle position;

selecting the at least one assigned town code of at least one town positioned in the search area;

at least one of optically outputting and acoustically outputting at least one town name corresponding to the at least one selected town code;

selectively choosing at least one of a destination area and a district from the at least one town name using an input device, the destination area being divided into predetermined districts, the input device including a key arrangement, each of the districts being assigned to a key of the key arrangement, the key arrangement being associated with a geographical location of the districts;

selecting at least one message associated with the at least one available parking facility for the selected district; and outputting at least one of the at least one available parking facility corresponding to the at least one message.

2. The method according to claim 1, wherein the step of receiving the parking data is performed using a Radio Data System.

3. The method according to claim 2, further comprising the step of:

receiving RDS data from the Radio Data System, wherein the at least one message is selected from the RDS data.

4. The method according to claim 1, wherein the at least one available parking facility corresponds to the selected district, and further comprising the step of:

automatically displaying the at least one available parking facility corresponding to the selected district.

5. The method according to claim 1, further comprising the step of:

assigning pathways of a public transit system to the selected district for outputting the pathways.

6. The method according to claim 5, wherein the pathways of the public transit system include schedules.

7. The method according to claim 5, further comprising the step of:

outputting the pathways of the public transit system and the at least one available parking facility on an electronic street map.

8. The method according to claim 1, wherein each of the at least one town has a corresponding assigned commuter area, and further comprising the step of:

selecting at least one available parking facility assigned to one of the at least one town if the current vehicle position is substantially in the commuter area.

9. An apparatus for locating at least one available parking facility for a motor vehicle, comprising:

a Radio Data System (RDS) transmitting RDS data and including an RDS receiver;

a message memory for storing at least one assigned town code corresponding to at least one town and for storing messages corresponding to the at least one available parking facility;

an input device including input keys and selecting at least one of a destination area and at least one district from the at least one assigned town code, the input keys of the input device being arranged as one of a key pad and a rocker key and being assigned to predetermined districts, the input keys including top keys, bottom keys and at least one further key;

a data output device receiving at least one assigned town code and outputting at least one town name corresponding to the at least one assigned town code;

a locating system determining a current position of the motor vehicle; and a controller connected to the locating system and selecting the at least one assigned town code corresponding to assigned data of the at least one available parking facility in the destination area using the RDS data, wherein the top keys correspond to northern districts of the predetermined districts, and the bottom keys correspond to southern districts of the predetermined districts, and wherein the at least one further key selects the destination area and requests a search for locating the at least one available parking facility.

10. The apparatus according to claim 9, wherein the Radio Data System includes a Traffic Message Channel (TMC) having a data protocol for selectively transmitting the assigned data of the at least one available parking facilities.

11. The apparatus according to claim 9, wherein the key pad includes at least one of a 9-key pad, a 10-key pad and a 16-key pad.

12. The apparatus according to claims 9, wherein the districts have a high resolution output obtained by one of repeatedly pressing one of the input keys of the input device and pressing one of the input keys at various times.

13. The apparatus according claim 9, wherein the apparatus is connected to one of a navigation guidance system and a destination guidance system for indicating a travel route to the at least one available parking facility having a location closest to a desired destination.

* * * * *